US005252451A

United States Patent [19]

Bell

[11] Patent Number: 5,252,451

[45] Date of Patent: Oct. 12, 1993

[54] PHOTOGRAPHIC EMULSIONS CONTAINING INTERNALLY AND EXTERNALLY MODIFIED SILVER HALIDE GRAINS

[75] Inventor: Eric L. Bell, Webster, N.Y.

[73] Assignee: Eastman Kodak Company, Rochester, N.Y.

[21] Appl. No.: 3,182

[22] Filed: Jan. 12, 1993

[51] Int. Cl.[5] ..... G03C 1/035; G03C 1/09

[52] U.S. Cl. ..... 430/567; 430/569; 430/604; 430/605

[58] Field of Search ..... 430/567, 569, 604, 605

[56] References Cited

U.S. PATENT DOCUMENTS

| | | | |
|---|---|---|---|
| 2,717,833 | 9/1955 | Wark | 97/7 |
| 3,672,901 | 6/1972 | Ohkubo et al. | 96/94 |
| 3,901,713 | 8/1975 | Yamasue et al. | 96/95 |
| 4,126,742 | 11/1978 | Sakai et al. | 96/110 |
| 4,147,542 | 4/1979 | Habu et al. | 96/27 E |
| 4,828,962 | 5/1989 | Greskowiak et al. | 430/230 |
| 4,835,093 | 5/1989 | Janusonis et al. | 430/567 |
| 4,847,191 | 7/1989 | Greskowiak | 430/605 |
| 4,933,272 | 6/1990 | McDugle et al. | 430/567 |
| 4,937,180 | 6/1990 | Marchetti et al. | 430/567 |
| 4,945,035 | 7/1990 | Keevert et al. | 430/567 |
| 4,981,781 | 1/1991 | McDugle et al. | 430/605 |
| 5,002,866 | 3/1991 | Kashi | 430/567 |
| 5,132,203 | 7/1992 | Bell et al. | 430/567 |

FOREIGN PATENT DOCUMENTS

| | | |
|---|---|---|
| 0325235 | 7/1989 | European Pat. Off. . |
| 0423765 | 4/1991 | European Pat. Off. . |
| 0457298 | 11/1991 | European Pat. Off. . |
| 1285-941-A | 1/1978 | Japan . |
| 3276-152-A | 4/1979 | Japan . |
| 4056-846-A | 6/1987 | Japan . |
| 3274-542-A | 3/1988 | Japan . |
| 2234151 | 9/1990 | Japan . |
| 554522 | 4/1977 | U.S.S.R. . |
| 1395923 | 5/1975 | United Kingdom . |

*Primary Examiner*—Janet C. Baxter
*Attorney, Agent, or Firm*—Peter C. Cody

[57] ABSTRACT

The present invention provides a photographic emulsion comprising silver halide grains, a dopant, and a grain surface modifier. The dopant is a transition metal selected from Group VIII of the periodic table. The grain surface modifier is characterized in that it comprises a transition metal complex having nitrosyl or thionitrosyl ligands with a transition metal selected from Groups V to X of the periodic table.

19 Claims, No Drawings

PHOTOGRAPHIC EMULSIONS CONTAINING INTERNALLY AND EXTERNALLY MODIFIED SILVER HALIDE GRAINS

FIELD OF THE INVENTION

This invention relates to photographic emulsions. In particular, it relates to photographic silver halide emulsions containing a dopant and a grain surface modifier, and having improved contrast.

BACKGROUND OF THE INVENTION

In both color and black and white photography, there exists the desire for products which exhibit increased contrast upon exposure to light and subsequent development. This desire is based upon the realization that contrast is directly related to the appearance of sharpness; and, it follows, that products which exhibit increased contrast give the visual impression of enhanced sharpness.

Traditionally, photographers have defined contrast by two methods, both of which are derived from the D-log E curve (also known as the "characteristic curve"; see James, The Theory of Photographic Properties, 4th ed. pp 501-504). The first method is the determination of gamma ($\gamma$, which is defined as the slope of the straight-line section of the D-log E curve. The second is the determination of the overall sharpness of the toe section of the D-log E curve. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point, although toe density may properly be measured at any point prior to the curve's primary increase in slope. The speed point corresponds to the point on the D-log E curve where density equals 1.0.

If either the value of $\gamma$ is high or the toe is sharp, then the image has a relatively high contrast. If the value of $\gamma$ is low or the toe is soft, the image has a relatively low contrast.

It is known that in attempts to maximize the contrast of photographic elements based on silver halide emulsions (as well as other characteristics of the photographic element), the silver halide emulsions have been doped with various transition metal ions and compounds. Dopants are substances added to the emulsion during silver halide precipitation which become incorporated within the internal structure of the silver halide grains. Because they are internally incorporated, they are distinguished from substances added post-precipitation such as chemical or spectral sensitizers. These latter compounds are externally associated with the surface of the silver halide grains and are thus more properly referred to as addenda or grain surface modifiers.

Depending on the level and location of dopants, they may modify the photographic properties of the grains. When the dopants are transition metals which form a part of a coordination complex, such as a hexacoordination complex or a tetracoordination complex, the ligands can also be occluded within the grains, and they too may modify the grain's photographic properties.

Specific examples of doped silver halide emulsions can be found in U.S. Pat. No. 4,147,542, which discloses the use of iron complexes having cyanide ligands; U.S. Pat. Nos. 4,945,035 and 4,937,180 which disclose the use of hexacoordination complexes of rhenium, ruthenium and osmium with at least four cyanide ligands; and U.S. Pat. No. 4,828,962, which discloses the use of ruthenium and iridium ions to reduce high intensity reciprocity failure (HIRF).

Recently, emulsion dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third, dicesium pentachloronitrosyl osmate, is disclosed in U.S. Pat. No. 4,933,272.

It has also been known to use combinations of dopants in silver halide emulsions. Such combinations of dopants can be found in U.S. Pat. No. 3,901,713, which discloses the addition of both rhodium and iridium compounds during emulsification or the first ripening; and in U.S. Pat. No. 3,672,901, which teaches the combined use of iron compounds and iridium or rhodium salts.

Methods of improving the photographic characteristics of silver halide emulsions have also consisted of adding transition metals to the emulsions during chemical or spectral sensitization. As mentioned, transition metals added in this manner, because they are added subsequent to silver halide precipitation, are referred to as grain surface modifiers rather than dopants.

The most prevalent chemical sensitizers are the gold and sulfur sensitizers, both of which are thought to enhance emulsion speed by forming electron traps and/or photoholes on the silver halide crystal surface. Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers (and also as dopants). The overall effect of these metals on sensitivity appears to be dependant upon their valence state.

Although it is known to employ transition metals, and combinations thereof, as either dopants or grain surface modifiers, prior applications of such transition metals have yielded emulsions exhibiting inferior contrast improvement. This has often been the result of one dopant or grain surface modifier exerting an insufficient effect; or the result of a combination of dopants or grain surface modifiers exerting opposing effects.

Accordingly, it would be desirable to overcome these deficiencies by providing a high contrast silver halide emulsion exhibiting a high $\gamma$ and/or sharpened toe, wherein the combination of a dopant and a grain surface modifier imparts the high contrast characteristic.

SUMMARY OF THE INVENTION

The present invention provides a photographic silver halide emulsion comprising silver halide grains, a dopant, and a grain surface modifier; wherein said dopant is a transition metal selected from Group VIII of the periodic table; and said grain surface modifier is a transition metal complex comprising a nitrosyl or thionitrosyl ligand with a transition metal selected from the Groups V to X of the periodic table.

The dopant utilized in accordance with the present invention is further characterized in that it is added to the emulsion during the precipitation of the silver halide crystals. Thus, it is incorporated into the internal structure of the crystalline grains. The grain surface modifier, by contrast, is added to the emulsion after silver halide precipitation. It is adsorbed to the surface of the crystal grain, rather than incorporated internally, and it, in combination with the dopant, unexpectedly improves the contrast of the silver halide emulsion.

In one aspect of the invention, the dopant and grain surface modifier are applied to silver chloride grains that are substantially free of silver bromide or silver iodide. In another aspect, the grain surface modifier is positioned at intervals along the surface of the silver chloride grains in a silver bromide carrier. The silver bromide carrier, in such instances, accounts for less than about 2, and preferably less than about 1, molar percent of the total silver halide of each crystal.

In these instances, the emulsions containing the combination of the dopant and the grain surface modifier according to this invention exhibit improved contrast.

DETAILED DESCRIPTION OF THE INVENTION

Components of silver halide emulsions are often distinguished by whether they are internally or externally associated with the silver halide crystal grains. Compounds which are added during silver halide precipitation, as mentioned previously, are internally incorporated within the crystal structure, and are thus termed dopants. By contrast, compounds added after precipitation become associated with the external surface of the grains. A variety of terms is used to define these compounds, including addenda and grain surface modifiers.

The present invention concerns high contrast silver halide emulsions containing both a dopant and a grain surface modifier. The dopant is preferably incorporated into a 93 percent core region of each silver halide grain; i.e. it is added during precipitation until 93 percent of the grain volume is formed. It may also, however, be added to the emulsion at a later stage of precipitation, as long as it is positioned below the surface of the silver halide grain.

The dopant utilized in accordance with the invention is a Group VIII transition metal. As such, it is defined according to the format of the periodic table adopted by the American Chemical Society and published in the Chemical and Engineering News, Feb. 4, 1985, p.26. Thus, it includes iron, ruthenium or osmium. Preferably, the Group VIII transition metal is associated with cyanide ligands. More preferably, it is in the form of an anion characterized by the formula:

$$[M(CN)_{6-y}L_y]^n$$

wherein

M is defined as a Group VIII transition metal;

L is a bridging ligand which serves as a bridging group between two or more metal centers in the crystal grain;

y is zero, 1, 2, or 3; and n is -2,-3,or-4.

Being closely associated with the transition metal dopant, the cyanide ligand and the ligand represented above by L are incorporated into the internal structure of the silver halide grain where they serve to modify the emulsion's photographic properties. Preferably, L is a halide, azide, or thiocyanate, although any ligand capable of functioning in a bridging capacity is also specifically contemplated.

Preferred examples of compounds incorporating dopants of the claimed invention are:

| | |
|---|---|
| TMC-1 | $[Ru(CN)_6]^{-4}$ |
| TMC-2 | $[Os(CN)_6]^{-4}$ |
| TMC-3 | $[Fe(CN)_6]^{-4}$ |
| TMC-4 | $[RuF(CN)_5]^{-4}$ |
| TMC-5 | $[OsF(CN)_5]^{-4}$ |
| TMC-6 | $[FeF(CN)_5]^{-4}$ |
| TMC-7 | $[RuCl(CN)_5]^{-4}$ |
| TMC-8 | $[OsCl(CN)_5]^{-4}$ |
| TMC-9 | $[FeCl(CN)_5]^{-4}$ |
| TMC-10 | $[RuBr(CN)_5]^{-4}$ |
| TMC-11 | $[OsBr(CN)_5]^{-4}$ |
| TMC-12 | $[FeBr(CN)_5]^{-4}$ |
| TMC-13 | $[RuI(CN)_5]^{-4}$ |
| TMC-14 | $[OsI(CN)_5]^{-4}$ |
| TMC-15 | $[FeI(CN)_5]^{-4}$ |
| TMC-16 | $[RuF_2(CN)_4]^{-4}$ |
| TMC-17 | $[OsF_2(CN)_4]^{-4}$ |
| TMC-18 | $[FeF_2(CN)_4]^{-4}$ |
| TMC-19 | $[RuCl_2(CN)_4]^{-4}$ |
| TMC-20 | $[OsCl_2(CN)_4]^{-4}$ |
| TMC-21 | $[FeCl_2(CN)_4]^{-4}$ |
| TMC-22 | $[RuBr_2(CN)_4]^{-4}$ |
| TMC-23 | $[OsBr_2(CN)_4]^{-4}$ |
| TMC-24 | $[FeBr_2(CN)_4]^{-4}$ |
| TMC-25 | $[RuI_2(CN)_4]^{-4}$ |
| TMC-26 | $[OsI_2(CN)_4]^{-4}$ |
| TMC-27 | $[FeI_2(CN)_4]^{-4}$ |
| TMC-28 | $[Ru(CN)_5(OCN)]^{-4}$ |
| TMC-29 | $[Os(CN)_5(OCN)]^{-4}$ |
| TMC-30 | $[Fe(CN)_5(OCN)]^{-4}$ |
| TMC-31 | $[Ru(CN)_5(SCN)]^{-4}$ |
| TMC-32 | $[Os(CN)_5(SCN)]^{-4}$ |
| TMC-33 | $[Fe(CN)_5(SCN)]^{-4}$ |
| TMC-34 | $[Ru(CN)_5(N_3)]^{-4}$ |
| TMC-35 | $[Os(CN)_5(N_3)]^{-4}$ |
| TMC-36 | $[Fe(CN)_5(N_3)]^{-4}$ |
| TMC-37 | $[Ru(CN)_5(H_2O)]^{-3}$ |
| TMC-38 | $[Os(CN)_5(H_2O)]^{-33}$ |
| TMC-39 | $[Fe(CN)_5(H_2O)]$-3 |
| TMC-40 | $[Ru(SCN)_6]^{-4}$ |
| TMC-41 | $[Os(SCN)_6]^{-4}$ |
| TMC-42 | $[Fe(SCN)_6]^{-4}$ |
| TMC-43 | $[Ru(OCN)_6]^{-4}$ |
| TMC-44 | $[Os(OCN)_6]^{-4}$ |
| TMC-45 | $[Fe(OCN)_6]^{-4}$ |

Most preferred are $[Fe(CN)_6]^{-4}$ and $[Ru(CN)_6]^{-}$; both are associated with 4K+1; $[Fe(CN)_6]^{-4}$ is also associated with three waters of crystalization (hydration).

The grain surface modifier suitable for the invention is a transition metal complex. It may be generically defined by the formula:

$$[TE_4(NZ)E']r$$

where

T is a transition metal selected from the Groups V to X, inclusive, of the periodic table;

Z is oxygen or sulfur, and together with nitrogen forms the nitrosyl or thionitrosyl ligand;

E and E' represent ligands additional to the nitrosyl or thionitrosyl ligand; and r is zero, −1, −2, or −3.

The ligand defined above by E can represent virtually any known type of ligand. Specific examples of preferred ligands include aquo ligands, halide ligands, cyanide ligands, cyanate ligands, thiocyanate ligands, selenocyanate ligands, tellurocyanate ligands, azide ligands, and other nitrosyl or thionitrosyl ligands. The ligand defined above by E' represents either E, nitorsyl or thionitrosyl.

Preferred grain surface modifies include:

| | |
|---|---|
| TMC-46 | $[V(NO)(CN)_5]^{-3}$ |
| TMC-47 | $[Cr(NO)(CN)_5]^{-3}$ |
| TMC-48 | $[Mn(NO)(CN)_5]^{-3}$ |
| TMC-49 | $[Fe(NO)(CN)_5]^{-2}$ |
| TMC-50 | $[Ru(NO)Cl_5]^{-2}$ |
| TMC-51 | $[Ru(NO)Br_5]^{-2}$ |
| TMC-52 | $[Ru(NO)I_5]^{-2}$ |
| TMC-53 | $[Ru(NO)F_5]^{-2}$ |
| TMC-54 | $[Ru(NO)Cl_3(H_2O)2]^{0}$ |
| TMC-55 | $[Ru(NO)Cl_3(H_2O)]^{-1}$ |
| TMC-56 | $[Ru(NO)Cl_4(OCN)]^{-2}$ |
| TMC-57 | $[Ru(NO)Cl_4(CN)]^{-2}$ |
| TMC-58 | $[Ru(NO)I_4(TeCN)]^{-2}$ |
| TMC-59 | $[Ru(NO)Cl_4(SCN)]^{-2}$ |
| TMC-60 | $[Ru(NO)Br_4(SeCN)]^{-2}$ |
| TMC-61 | $[Ru(NO)I_4(SeCN)]^{-2}$ |
| TMC-62 | $[Ru(NO)Cl_3(CN)_2]^{-2}$ |
| TMC-63 | $[Ru(NO)Br_2(CN)_3]^{-2}$ |
| TMC-64 | $[Ru(NO)I_2(CN)_3]^{-2}$ |
| TMC-65 | $[Ru(NO)Cl_4(N_3)]^{-2}$ |
| TMC-66 | $[Ru(NO)Cl(CN)_4]^{-2}$ |
| TMC-67 | $[Ru(NO)Br(SCN)_4]^{-2}$ |
| TMC-68 | $[Ru(NO)I(SCN)_4]^{-2}$ |
| TMC-69 | $[Ru(NO)I(CN)_5]^{-2}$ |
| TMC-70 | $[Os(NO)Cl_5]^{-2}$ |
| TMC-71 | $[Os(NO)Br_5]^{-2}$ |
| TMC-72 | $[Os(NO)I_5]^{-2}$ |
| TMC-73 | $[Os(NO)F_5]^{-2}$ |
| TMC-74 | $[Os(NO)Cl_4(TeCN)]^{-2}$ |
| TMC-75 | $[Os(NO)Br_4(OCN)]^{-2}$ |
| TMC-76 | $[Os(NO)I_4(TeCN)]^{-2}$ |
| TMC-77 | $[Os(NO)Cl_4(SeCN)]^{-2}$ |
| TMC-78 | $[Os(NO)Br_4(SeCN)]^{-2}$ |
| TMC-79 | $[Os(NO)I_4(SeCN)]^{-2}$ |
| TMC-80 | $[Os(NO)Cl_3(CN)_2]^{-2}$ |
| TMC-81 | $[Os(NO)Br_2(CN)_3]^{-2}$ |
| TMC-82 | $[Os(NO)I_2(SCN)_3]^{-2}$ |
| TMC-83 | $[Os(NO)Cl_2(SCN)_3]^{-2}$ |
| TMC-84 | $[Os(NO)Cl(CN)_4]^{-2}$ |
| TMC-85 | $[Os(NO)Br(CN)_4]^{-2}$ |
| TMC-86 | $[Os(NO)I(SCN)_4]^{-2}$ |
| TMC-87 | $[Os(NO)(CN)_5]^{-2}$ |
| TMC-88 | $[Re(NO)(CN)_5]^{-2}$ |
| TMC-89 | $[Re(NO)Cl_5]^{-2}$ |
| TMC-90 | $[Re(NO)Br_5]^{-2}$ |
| TMC-91 | $[Re(NO)Cl_2(CN)_3]^{-2}$ |
| TMC-92 | $[Ir(NO)Cl_5]^{-1}$ |
| TMC-93 | $[Ir(NO)Br_5]^{-1}$ |
| TMC-94 | $[Ir(NO)I_5]^{-1}$ |
| TMC-95 | $[Ir(NO)Cl_3BrI]^{-1}$ |
| TMC-96 | $[Ru(NS)Cl_5]^{-2}$ |
| TMC-97 | $[Os(NS)Br_5]^{-2}$ |
| TMC-98 | $[Ru(NS)I_5]^{-2}$ |
| TMC-99 | $[Os(NS)Cl_4(N_3)]^{-2}$ |
| TMC-100 | $[Ru(NS)Br_4(N_3)]^{-2}$ |
| TMC-101 | $[Os(NS)I_4(N_3)]^{-2}$ |
| TMC-102 | $[Ru(NS)Cl_4(CN)]^{-2}$ |
| TMC-103 | $[Os(NS)Br_4(CN)]^{-2}$ |
| TMC-104 | $[Ru(NS)I_4(CN)]^{-2}$ |
| TMC-105 | $[Os(NS)Cl_4(SCN)]^{-2}$ |
| TMC-106 | $[Ru(NS)Br_4(SCN)]^{-2}$ |
| TMC-107 | $[Os(NS)I_4(SCN)]^{-2}$ |
| TMC-108 | $[Ru(NS)Cl_4(SeCN)]^{-2}$ |
| TMC-109 | $[Os(NS)Br_4(SeCN)]^{-2}$ |
| TMC-110 | $[Ru(NS)I_4(SeCN)]^{-2}$ |
| TMC-111 | $[Os(NS)Cl_3(N_3)_2]^{-2}$ |
| TMC-112 | $[Ru(NS)Br_3(CN)_2]^{-2}$ |
| TMC-113 | $[Os(NS)Cl_3(SCN)_2]^{-2}$ |
| TMC-114 | $[Ru(NS)Cl_3(SeCN)_2]^{-2}$ |
| TMC-115 | $[Ru(NS)Cl_2(N_3)_3]^{-2}$ |
| TMC-116 | $[Os(NS)I_2(CN)_3]^{-2}$ |
| TMC-117 | $[Os(NS)Br_2(SCN)_3]^{-2}$ |
| TMC-118 | $[Ru(NS)Cl_2(SeCN)_3]^{-2}$ |
| TMC-119 | $[Ru(NS)Cl_2(N_3)_3]^{-2}$ |
| TMC-120 | $[Os(NS)I_2(CN)_3]^{-2}$ |
| TMC-121 | $[Ru(NS)Br_2(SCN)_3]^{-2}$ |
| TMC-122 | $[Os(NS)Cl_2(SeCN)_3]^{-2}$ |
| TMC-123 | $[Os(NS)Cl(N_3)_4]^{-2}$ |
| TMC-124 | $[Ru(NS)I(CN)_4]^{-2}$ |
| TMC-125 | $[Ru(NS)Cl(SCN)_4]^{-2}$ |
| TMC-126 | $[Os(NS)Cl(SeCN)_4]^{-2}$ |
| TMC-127 | $[Ru(NS)(CN)_5]^{-2}$ |

-continued

| | |
|---|---|
| TMC-128 | $[Ru(NS)(SCN)_5]^{-2}$ |
| TMC-129 | $[Os(NS)(SeCN)_5]^{-2}$ |
| TMC-130 | $[Ru(NS)(N_3)_5]^{-2}$ |
| TMC-131 | $[Mo(NO)_2(CN)_4]^{-2}$ |

Most preferred is $[Os(NO)C15]^{-2}$; and it is associated with a cation, namely $2Cs^{+1}$, to form $Cs_2Os(NO)Cl_5$.

The grain surface modifier of the present invention is applied to the emulsion during finishing. Finishing relates to any procedure performed subsequent to silver halide precipitation whereby substances are added to the emulsion in order to modify the surfaces of the silver halide grains. It therefore includes such procedures as chemical sensitization, spectral sensitization and, in certain circumstances, physical ripening.

Finishing may also include a procedure wherein the grain surface modifier is deposited at intervals along the surface of the silver halide grains in a silver bromide carrier. The silver bromide carrier, in such instances, accounts for less than about 2, and preferably less than about 1, molar percent of the crystals total halide content.

Finishing in this manner is preferably performed by means of Lippmann bromide carriers. Specifically, a Lippmann bromide emulsion (which is a very fine grain silver bromide emulsion having average grain sizes around 0.05 microns) will have incorporated in its grains certain levels of the grain surface modifier. These emulsions are digested in the presence of the much larger silver halide grains of the present invention. They are then allowed to recrystalize on the surface of the larger grains, thus delivering the grain surface modifier.

Because the Lippmann bromide carriers account for less than about 2, and preferably less than about 1, molar percent of the total halide in the silver halide grains, they do not form a shell around the larger grains. Rather, they form deposits at intervals along the surface of the grains. Generally, these deposits will form at the corners of the silver halide grains.

It is also possible to form the emulsions of the present invention by adding the grain surface modifier alone to a post-precipitation doped emulsion. However, it is preferred to apply the grain surface modifier by means of Lippmann bromide carriers which will bind to the surface of the much larger silver halide grains. If Lippmann bromide carriers are not used, and the silver halide grains are predominately silver chloride, it is preferred to apply the grain surface modifier along with a solution of potassium bromide. As small amounts of the bromide displace chloride molecules on the surface of the silver chloride grain, the grain surface modifier will tend to be "swept onto" the grain surfaces.

The grain surface modifier and dopant used in the present invention are preferably applied to a silver chloride emulsion which has been ripened in the presence of a ripening agent. Also, it is preferred that the grain surface modifier be applied to the emulsion in amounts between about $7.5\times10^{-10}$ and about $2.0\times10^{-8}$ moles per mole of silver chloride; and that the dopant be applied in amounts between about $1\times10^{-6}$ and about $5\times10^{-4}$ moles per mole of silver chloride. More preferably, the dopant is applied in amounts between about $5\times10^{-6}$ and about $3\times10^{-5}$ moles per mole of silver chloride. Optimally, the dopant is in an amount equal to $2.5\times10^{-5}$ moles per mole of silver halide, and the grain surface modifier is in an amount equal to $3.0\times10^{-9}$ moles per mole of silver chloride.

The silver halide grains capable of being used in the present invention are of any known type. They can be formed of bromide ions as the sole halide, chloride ions as the sole halide, or any mixture of the two. They may also have incorporated within, minor amounts of iodide ions. Generally, though, iodide concentrations in silver halide grains seldom exceed 20 mole percent and are typically less than 10 mole percent, based on silver. However, specific applications differ widely in their use of iodide. In high speed (ASA 100 or greater) camera films, silver bromoiodide emulsions are employed since the presence of iodide allows higher speeds to be realized at any given level of granularity. In radiography, silver bromide emulsions or silver bromoiodide emulsions containing less than 5 mole percent iodide are customarily employed. Emulsions employed for the graphic arts and color paper, by contrast, typically contain greater than 50 mole percent chloride. Preferably they contain greater than 70 mole percent, and optimally greater than 85 mole percent, chloride. The remaining halide in such emulsions is preferably less than 5 mole percent, and optimally less than 2 mole percent, iodide, with any balance of halide not accounted for by chloride or iodide being bromide.

The advantages of the invention would be present in any of the above-mentioned types of emulsions, although it is preferred that the emulsions comprise silver chloride grains which are substantially free of silver bromide or silver iodide. By substantially free, it is meant that such grains are greater than about 90 molar percent silver chloride. Optimally, silver chloride accounts for about 99 molar percent of the silver halide in the emulsion.

Moreover, the invention may be practiced in black-and-white or color films utilizing any other type of silver halide grains. The grains may be conventional in form such as cubic, octahedral, dodecahedral, or octadecahedral, or they may have an irregular form such as spherical grains or tabular grains. Further, the grains of the present invention may be of the type having <100>, <111>, or other known orientation, planes on their outermost surfaces.

The invention may further be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure*, December, 1989, 308119, Sections I-IV at pages 993-1000.

After precipitation of the silver halide grains in the presence of the dopant, the doped emulsions are washed to remove excess salt. At this time the grain surface modifier of the present invention may be added, or it may be added at a later time such as during chemical or spectral sensitization. Both chemical and spectral sensitization may be performed in any conventional manner as disclosed in the above-referenced *Research Disclosure* 308119.

Specific sensitizing dyes which can be used in accordance with the invention include the polymethine dye class, which further includes the cyanines, merocyanines, complex cyanines and merocyanines (i.e. tri-, tetra- and polynuclear cyanines and merocyanines), oxonols, hemioxonols, styryls, merostyryls, and streptocyanines. Other dyes which can be used are disclosed *Research Disclosure* 308119.

Chemical sensitizers which can be used in accordance with the invention include the gold and sulfur class sensitizers, or the transition metal sensitizers as discussed above. Further, they can be combined with any of the known antifoggants or stabilizers such as those disclosed in *Research Disclosure* 308119, Section VI. These may include halide ions, chloropalladates, and chloropalladites. Moreover, they may include thiosulfonates, quaternary ammonium salts, tellurazolines, and water soluble inorganic salts of transition metals such as magnesium, calcium, cadmium, cobalt, manganese, and zinc.

After sensitizing, the emulsions can be combined with any suitable coupler (whether two or four equivalent) and/or coupler dispersants to make the desired color film or print photographic materials; or they can be used in black-and-white photographic films and print material. Couplers which can be used in accordance with the invention are described in *Research Disclosure* Vol. 176, 1978, Section 17643 VIII and *Research Disclosure* 308119 Section VII, the entire disclosures of which are incorporated by reference.

The emulsions of the invention may further be incorporated into a photographic element and processed, upon exposure, by any known method (such as those methods disclosed in U.S. Pat. No. 3,822,129). Typically, a color photographic element comprises a support, which can contain film or paper sized by any known sizing method, and at least three different color forming emulsion layers. The element also typically contains additional layers, such as filter layers, interlayers, overcoat layers, subbing layers, and the like. It may contain brighteners, antistain agents, hardeners, plasticizers and lubricants, as well as matting agents and development modifiers. Specific examples of each of these, and their manners of application, are disclosed in the above-referenced *Research Disclosure* 308119, and *Research Disclosure* 17643.

The invention can be better appreciated by reference to the following specific examples. They are intended to be illustrative and not exhaustive of the grains of the present invention and their methods of formation.

EXAMPLES

Emulsion Preparation for Examples 1-14

The emulsions for examples 1-14 used conventional precipitation techniques employing thioether silver halide ripening agents of the type disclosed in U.S. Pat. No. 3,271,157.

Emulsion 1 was prepared in a reaction vessel, wherein 8.5 liters of a 2.8 percent by weight gelatin aqueous solution and 1.8 grams of 1,8-dihydroxy-3,6-diathiaoctane were adjusted to a temperature of 68.3° C., pH of 5.8, and a pAg of 7.35 by addition of NaCl solution. A 3.75 molar solution containing 1658.0 grams of AgNO3 in water and a 3.75 molar solution containing 570.4 grams of NaCl in water were simultaneously run into the reaction vessel with rapid stirring, each at a flow rate of 84 ml/min. The double jet precipitation continued for 31 minutes at a controlled pAg of 7.35. A total of 9.76 moles of silver chloride was precipitated, the silver chloride having cubic morphology of 0.60 micron average cube length.

Emulsion 2 was prepared exactly as Emulsion 1 except 0.103 grams of $K_4Fe(CN)_6.3(H_2O)$ was added to the NaCl solution which was simultaneously run into the reaction vessel during the initial 50% of the double jet precipitation (0-50%). A total of 9.76 moles of silver chloride containing $25\times10^{-6}$ moles of $Fe(CN)_6$ per mole of silver chloride was precipitated. The morphology was cubic with average cubic edge length of 0.60 microns.

Emulsion 3 was prepared exactly as Emulsion 1 except 0.103 grams of $K_4Fe(CN)_6.3(H_2O)$ was added to the NaCl solution which was simultaneously run into the reaction vessel during the final 50% of the double jet precipitation (50-100%). A total of 9.76 moles of silver chloride containing $25\times10^{-6}$ moles of Fe(CN)6 per mole of silver chloride was precipitated. The morphology was cubic with average cubic edge length of 0.60 microns.

Emulsion 4 was prepared exactly as Emulsion 1 except 0.101 grams of $K_4Ru(CN)_6$ was added to the NaCl solution which was simultaneously run into the reaction vessel during the initial 50% of the double jet precipitation (0–50%). A total of 9.76 moles of silver chloride containing $25\times10^{-6}$ moles of $Ru(CN)_6$ per mole of silver chloride was precipitated. The morphology was cubic with average cubic edge length of 0.60 microns.

Emulsion 5 was prepared exactly as Emulsion 4 except the addition of the NaCl solution containing 0.101 grams of $K_4Ru(CN)_6$ began at 12.4 minutes and ended at 27.9 minutes into the 31 minute double jet precipitation (40–90%). A total of 9.76 moles of silver chloride containing $25\times10^{-6}$ moles of Ru(CN)6 per silver chloride was precipitated. The morphology was cubic with average cubic edge length of 0.60 microns.

Emulsion 6 was prepared exactly as Emulsion 1 except 0.101 grams of $K_4Ru(CN)_6$ was added to the NaCl solution which was simultaneously run into the reaction vessel during the final 50% of the double jet precipitation (50–100%). A total of 9.76 moles of silver chloride containing $25\times10^{-6}$ moles of $Ru(CN)_6$ per mole of silver chloride was precipitated. The morphology was cubic with average cubic edge length of 0.60 microns.

A series of Lippmann bromide carriers was prepared for the addition of $Os(NO)Cl_5$ as a grain surface modifier to Emulsions 1–6. Preparation of the Lippmann bromide carriers was as follows:

Emulsion L-1 was prepared in a reaction vessel wherein 4.0 liters of a 5.6 percent by weight gelatin aqueous solution was adjusted to a temperature of 40° C., pH of 5.8, and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 ml/min. The double jet precipitation continued for 3 minutes at a controlled pAg of 8.86, after which the double jet precipitation continued for 17 minutes while pAg decreased linearly from 8.86 to 8.06. A total of 10 moles of silver bromide (Lippmann bromide) was precipitated, the silver bromide having average grain sizes of 0.05 microns.

Emulsion L-2 was prepared exactly as Emulsion L-1 except a solution of 0.011 grams of $Cs_2Os(NO)Cl_5$ in 25 ml water was added at a constant flow rate during precipitation of the Lippmann bromide carriers. This triple jet precipitation produced 10 moles of a 0.05 micron particle diameter emulsion.

EXAMPLES 1–6

Application of $Os(NO)Cl_5$ as a grain surface modifier to the ripened emulsion containing silver halide grains doped with $Fe(CN)_6$ was as follows:

Example 1 was prepared by heating a 50 millimole (mmole) samples of Emulsion 1 to 40° C., and spectrally sensitizing it by conventional methods. Then, 0.45 mmoles of Emulsion L-1 were added to Emulsion 1, as well as, appropriate amounts of sodium thiosulfate and 4-hydroxy-6-methyl-1,3,3a,7tetraazaindene. The emulsion was heated at 60° C. for 20-70 minutes until optimal chemical sensitization was achieved. Addition of 1-(3-acetamidophenyl)-5-mercaptotetrazole followed to complete the finishing operation.

Example 2 was prepared in the same way as Example 1 except that Emulsion 2 was used instead of Emulsion 1.

Example 3 was prepared in the same way as Example 1 except that Emulsion 3 was used instead of Emulsion 1.

Example 4 was prepared in the same way as Example 1 except that 0.09 mmoles of Emulsion L 2 and 0.036 mmoles of Emulsion L-1 were added instead of 0.45 mmoles of Emulsion L-1.

Example 5 was prepared in the same way as Example 4 except that Emulsion 2 was used instead of Emulsion 1.

Example 6 was prepared in the same way as Example 4 except that Emulsion 3 was used instead of Emulsion 1.

All emulsions were coated on paper support that had been sized using the sizing methods disclosed in U.S. Pat. No. 4,994,147. Coating was at 0.28 grams/$m^2$ silver with 0.002 grams/$m^2$ silver of 2,4 dihydroxy-4-methyl-1-piperidinocyclopenten-3-one, 0.02 grams/$m^2$ of KCl, and 1.08 grams/$m^2$ yellow forming coupler added to give a layer with 0.166 grams/$m^2$ gelatin. A 1.1 grams/$m^2$ gelatin protective overcoat layer was applied along with a vinylsulfone gelatin hardener.

The coatings were exposed through a step tablet to a 3000K light source for 0.1 second and processed as recommended in "Using KODAK EKTACOLOR RA Chemicals", Publication No. Z-130, published by Eastman Kodak Co., 1990.

The results are shown in Table 1 and correspond to sensitometric data points on each emulsions D-log E curve. They illustrate the invention resides in an emulsion containing the combination of a dopant and a grain surface modifier. As can be seen from Examples 5–6, such an emulsion exhibits a very large contrast increase. Toe density, for instance, is much sharper (smaller value) with the combination of a dopant and a grain surface modifier than with either one alone, or even the additive effects of both together. Similarly, gamma is much higher with the combination of the dopant and grain surface modifier.

Further understanding of the invention may be garnered by the reference to the columns labeled "% Toe change". The values in these columns correspond to the change in toe density from an unmodified emulsion (i.e. Example 1), and they illustrate that emulsions containing the combination of a dopant and a grain surface modifier exhibit the greatest contrast improvement.

TABLE 1

| Example | | Grain Surface Modifier Os(NO)[1] | Dopant Fe(CN)[2] | Location of Dopant in Grain | Speed[3] | 0.3 Toe[4] | Gamma[5] | 0.3% Toe Change |
|---|---|---|---|---|---|---|---|---|
| 1 | Control | — | — | — | 145 | 0.445 | 2.39 | 0.00 |
| 2 | Control | — | 25.0 | 0-50% | 155 | 0.445 | 2.38 | 0.00 |
| 3 | Control | — | 25.0 | 50-100% | 157 | 0.396 | 2.92 | −11.01 |
| 4 | Control | 3.0 | — | — | 126 | 0.329 | 2.86 | −26.07 |
| 5 | Invention | 3.0 | 25.0 | 0-50% | 139 | 0.226 | 3.39 | −49.21 |
| 6 | Invention | 3.0 | 25.0 | 50-100% | 140 | 0.186 | 4.18 | −58.20 |

[1]Molar part per billion $Os(NO)Cl_5$/mole AgCl
[2]Molar part per million $Fe(CN)_6$/mole AgCl
[3]The reciprocal of the relative amount of light in LogE × 100 to produce 1.0 density
[4]The density value of the point 0.3 logE fast of the speed point
[5]Slope of a line tangent to the sensitometric curve at the speed point.

EXAMPLES 7-14

Application of $Os(NO)Cl_5$ as a grain surface modifier to the ripened emulsion containing silver halide grains doped with $Ru(CN)_6$ was as follows:

Example 7 was prepared exactly as Example 1.

Example 8 was prepared in the same way as Example 1 except that Emulsion 4 was used instead of Emulsion 1.

Example 9 was prepared in the same way as Example 1 except that Emulsion 5 was used instead of Emulsion 1.

Example 10 was prepared in the same way as Example 1 except that Emulsion 6 was used instead of Emulsion 1.

Example 11 was prepared exactly as Example 4.

Example 12 was prepared in the same way as Example 4 except that Emulsion 4 was used instead of Emulsion 1.

Example 13 was prepared in the same way as Example 4 except that Emulsion 5 was used instead of Emulsion 1.

Example 14 was prepared in the same way as Example 4 except that Emulsion 6 was used instead of Emulsion 1.

All emulsions were coated on paper support using the sizing methods disclosed in U.S. Pat. No. 4,994,147 and processed in a manner similar to Examples 1-6. The results are shown in Table 2 and correspond to sensitometric data points on each emulsion D-log E curve. The results illustrate the increased contrast according to the present invention can be obtained with ruthenium hexacyanide in place of ferrous hexacyanide.

EMULSION PREPARATION FOR EXAMPLES 15-26

The emulsions for Examples 15-26 were prepared using conventional methods known in the art without the use of silver halide ripening agents.

Emulsion 7 was prepared in a reaction vessel wherein 8.5 liters of a 2.8 percent by weight gelatin aqueous solution were adjusted to a temperature of 68.3° C., pH of 5.8, and a pAg of 7.35 by addition of NaCl solution. A 3.75 molar solution containing 1658.0 grams of $AgNO_3$ in water and a 3.75 molar solution containing 570.4 grams of NaCl were simultaneously run into the reaction vessel with rapid stirring, each at a constant flow rate of 27.3 ml/min. The double jet precipitation continued for 1.5 minutes at a controlled pAg of 7.35. At this point the flow rates were increased linearly at a rate of 4.04 ml/min$^2$. The double jet precipitation continued for 29.5 minutes at a controlled pAg of 7.35. A total of 9.76 moles of silver chloride was precipitated. Silver chloride grains of 0.60 micron average cubic edge length were obtained.

Emulsions 8-11 were prepared like Emulsions 2-4, and 6, respectively, except that precipitation occurred without the aid of ripening agents. Further, flow rates and precipitation times for emulsions 8-11 were in accordance with the preparation of Emulsion 7.

EXAMPLES 15-26

Application of $Os(NO)Cl_5$ as a grain surface modifier to the unripened emulsion containing silver halide grains doped with either $Fe(CN)_6$ or $Ru(CN)_6$ was according to the procedures disclosed for Examples 1-6, except that no emulsion was precipitated which contained silver halide grains having ruthenium only in the 40-90 percent band. Thus, Example 15 was prepared

TABLE 2

| Example | | Grain Surface Modifier Os(NO)[1] | Dopant Ru(CN)[2] | Location of Dopant in Grain | Speed[3] | 0.3 Toe[4] | Gamma[5] | 0.3% Toe Change |
|---|---|---|---|---|---|---|---|---|
| 7 | Control | — | — | — | 145 | 0.445 | 2.39 | 0.00 |
| 8 | Control | — | 25.0 | 0-50% | 148 | 0.429 | 2.42 | −3.60 |
| 9 | Control | — | 25.0 | 40-90% | 160 | 0.423 | 2.54 | −4.94 |
| 10 | Control | — | 25.0 | 50-100% | 155 | 0.413 | 2.45 | −7.19 |
| 11 | Control | 3.0 | — | — | 126 | 0.329 | 2.86 | −26.07 |
| 12 | Invention | 3.0 | 25.0 | 0-50% | 135 | 0.261 | 3.13 | −41.35 |
| 13 | Invention | 3.0 | 25.0 | 40-90% | 145 | 0.214 | 3.78 | −51.91 |
| 14 | Invention | 3.0 | 25.0 | 50-100% | 140 | 0.218 | 3.53 | −51.01 |

[1]Molar part per billion $Os(NO)Cl_5$/mole AgCl
[2]Molar part per million $Ru(CN)^2$/mole AgCl
[3]The reciprocal of the relative amount of light in LogE × 100 to produce 1.0 density
[4]The density value of the point 0.3 logE fast of the speed point
[5]Slope of a line tangent to the sensitometric curve at the speed point.

using Emulsion 7 instead of Emulsion 1; Example 16 was prepared using Emulsion 8 instead of Emulsion 1; Example 17 was prepared using Emulsion 9 instead of Emulsion 1, and so forth.

The results of Examples 15-26 are shown in Tables 3 and 4 and correspond to sensitometric data points on each emulsions D-log E curve. They illustrate that the advantages of the present invention can be found with emulsions containing unripened grains, especially when elevated levels of grain surface modifiers or dopants are used, or when the levels of such compounds are optimized.

Table 3 illustrates the use of ferrous hexacyanide as the dopant in an unripened emulsion.

TABLE 3

| Example | | Grain Surface Modifier Os(NO)[1] | Dopant Fe(CN)[2] | Location of Dopant in Grain | Speed[3] | 0.3 Toe[4] | Gamma[5] | 0.3% Toe Change |
|---|---|---|---|---|---|---|---|---|
| 15 | Control | — | — | — | 141 | 0.499 | 2.08 | 0.00 |
| 16 | Control | — | 25.0 | 0-50% | 142 | 0.494 | 2.12 | −1.00 |
| 17 | Control | — | 25.0 | 50-100% | 170 | 0.390 | 2.39 | −21.84 |
| 18 | Control | 3.0 | — | — | 132 | 0.390 | 2.49 | −21.84 |
| 19 | Invention | 3.0 | 25.0 | 0-50% | 135 | 0.445 | 2.32 | −10.82 |
| 20 | Invention | 3.0 | 25.0 | 50-100% | 154 | 0.291 | 3.22 | −41.68 |

[1]Molar part per billion $Os(NO)Cl_5$/mole AgCl
[2]Molar part per million $Fe(CN)_6$/mole AgCl
[3]The reciprocal of the relative amount of light in LogE × 100 to produce 1.0 density
[4]The density value of the point 0.3 logE fast of the speed point
[5]Slope of a line tangent to the sensitometric curve at the speed point.

Table 4 illustrates the use of ruthenium hexacyanide in an unripened emulsion.

TABLE 4

| Example | | Grain Surface Modifier Os(NO)[1] | Dopant Ru(CN)[2] | Location of Dopant in Grain | Speed[3] | 0.3 Toe[4] | Gamma[5] | 0.3% Toe Change |
|---|---|---|---|---|---|---|---|---|
| 21 | Control | — | — | — | 141 | 0.499 | 2.08 | 0.00 |
| 22 | Control | — | 25.0 | 0-50% | 148 | 0.459 | 2.11 | −8.02 |
| 23 | Control | — | 25.0 | 50-100% | 167 | 0.386 | 2.31 | −22.65 |
| 24 | Control | 3.0 | — | — | 132 | 0.390 | 2.49 | −21.84 |
| 25 | Invention | 3.0 | 25.0 | 0-50% | 142 | 0.393 | 2.36 | −21.24 |
| 26 | Invention | 3.0 | 25.0 | 50-100% | 153 | 0.316 | 2.79 | −36.67 |

[1]Molar part per billion $Os(NO)Cl_5$/mole AgCl
[2]Molar part per million $Ru(CN)^2$/mole AgCl
[3]The reciprocal of the relative amount of light in LogE × 100 to produce 1.0 density
[4]The density value of the point 0.3 logE fast of the speed point
[5]Slope of a line tangent to the sensitometric curve at the speed point.

The invention has been described in detail with particular reference to preferred embodiments thereof but it will be understood that variations and modifications can be effected within the spirit and scope of the invention.

What is claimed:

1. A photographic silver halide emulsion comprising silver halide grains, a dopant, and a grain surface modifier; wherein said dopant is a transition metal complex containing a transition metal selected from Group VIII of the periodic table; and said grain surface modifier is a transition metal complex comprising a nitrosyl or thionitrosyl ligand with a transition metal selected from the Groups V to X of the periodic table.

2. A photographic emulsion according to claim 1 wherein said silver halide grains contain silver chloride and are substantially free of silver bromide or silver iodide.

3. A photographic emulsion according to claim 2 wherein said grain surface modifier is positioned at intervals along the surface of said silver chloride grains in a silver bromide carrier, said silver bromide carrier accounting for less than about 2 molar percent of said silver halide grain.

4. A photographic emulsion according to claim 3 wherein said silver bromide carrier accounts for less than about 1 molar percent of said silver halide grain.

5. A photographic emulsion according to claim 4 wherein said dopant contains cyanide ligands.

6. A photographic emulsion according to claim 5 wherein said dopant is in the form of an anion having by the formula:

$$[M(CN)_{6-y}L_y]^n$$

wherein

M is a Group VIII transition metal;
L is a bridging ligand;

y is zero, 1, 2, or 3; and
n is −2, −3, or −4.

7. A photographic emulsion according to claim 6 wherein said dopant is in the form of $[Fe(CN)_6]^{-4}$.

8. A photographic emulsion according to claim 7 comprising $[Fe(CN)_6]^{-4}$ in amounts between about $1\times10^{-6}$ and about $5\times10^{-4}$ moles per mole of silver chloride.

9. A photographic emulsion according to claim 8 comprising $[Fe(CN)_6]^{-4}$ in amounts between about $5\times10^{-6}$ and about $3\times10^{-5}$ moles per mole of silver chloride.

10. A photographic emulsion according to claim 9 comprising $[Fe(CN)_6]^{-4}$ in an amount equal to $2.5\times10^{-5}$ moles per mole of silver halide.

11. A photographic emulsion according to claim 6 wherein said dopant is in the form of $[Ru(CN)_6]^{-4}$.

12. A photographic emulsion according to claim 11 comprising $[Ru(CN)_6]^{-4}$ in amounts between about $1\times10^{-6}$ and about $5\times10^{-4}$ moles per mole of silver chloride.

13. A photographic emulsion according to claim 12 comprising $[Ru(CN)_6]^{-4}$ in amounts between about $5\times10^{-6}$ and about $3\times10^{-5}$ moles per mole of silver chloride.

14. A photographic emulsion according to claim 13 comprising $[Ru(CN)_6]^{-4}$ in an amount equal to $2.5\times10^{-5}$ moles per mole of silver halide.

15. A photographic emulsion according to claims 2 or 6 wherein said grain surface modifier has the formula:

$$[TE_4(NZ)E']^r$$

wherein

T is a transition metal selected from Groups V to X, inclusive, of the periodic table;

Z is oxygen or sulfur, and together with nitrogen forms the nitrosyl or thionitrosyl ligand;

E and E' represent ligands; and r is zero, −1, −2, or −3.

16. A photographic emulsior according to claim 15 wherein said grain surface modifier is $Os(NO)Cl_5]^{-2}$.

17. A photographic emulsion according to claim 16 comprising $[Os(NO)Cl_5]^{-2}$ in an amount between about $7.5\times10^{-10}$ and about $2.0\times10^{-8}$ moles per mole of silver chloride.

18. A photographic emulsion according to claim 1 wherein said dopant is incorporated throughout 93 percent of the volume of said silver halide grains.

19. A photographic silver halide emulsion comprising silver halide grains internally modified by a dopant and externally modified by a grain surface modifier; wherein said grain surface modifier is a transition metal complex comprising a nitrosyl or thionitrosyl ligand with a transition metal selected from Groups V to X, inclusive,, of the periodic table; and wherein said dopant is a transition metal complex containing a transition metal selected from the group consisting of ruthenium and iron.

* * * * *

UNITED STATES PATENT AND TRADEMARK OFFICE

CERTIFICATE OF CORRECTION

PATENT NO. : 5,252,451

DATED : Oct. 12, 1993

INVENTOR(S) : Eric L. Bell

It is certified that error appears in the above-indentified patent and that said Letters Patent is hereby corrected as shown below:

In Column 16, line 1, delete "emulsior" and insert --emulsion--.

In Column 16, line 2, delete "Os" and insert --[Os--.

In Column 16, line 16, delete "inclusive,," and insert --inclusive,--.

Signed and Sealed this

Twenty-second Day of March, 1994

*Attest:*

Bruce Lehman

BRUCE LEHMAN

*Attesting Officer*

*Commissioner of Patents and Trademarks*